US006434996B1

(12) United States Patent
Aschberger et al.

(10) Patent No.: US 6,434,996 B1
(45) **Date of Patent: *Aug. 20, 2002**

(54) PUNCH ASSEMBLY FOR FORMING A BASE IN A METAL BEVERAGE CAN

(75) Inventors: Anton A. Aschberger, Downers Grove; Ralph J. Trnka, Tinley Park; Robert A. Winkless, Oak Lawn, all of IL (US)

(73) Assignee: Crown Cork & Seal Technologies Corporation, Alsip, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 45 days.

(21) Appl. No.: 09/095,813

(22) Filed: Jun. 11, 1998

(51) Int. Cl.[7] ..... B21D 22/28
(52) U.S. Cl. ..... 72/348; 72/349
(58) Field of Search ..... 72/347, 348, 349

(56) References Cited

U.S. PATENT DOCUMENTS

| | | | | | |
|---|---|---|---|---|---|
| 4,065,951 | A | * | 1/1978 | Lyu | 72/349 |
| 4,134,354 | A | * | 1/1979 | Cvacho et al. | 72/348 |
| 4,620,434 | A | * | 11/1986 | Pulciano et al. | 72/349 |
| 5,208,435 | A | | 5/1993 | Main et al. | 219/121.13 |
| 5,318,648 | A | | 6/1994 | Heyes et al. | 156/244.24 |
| 5,343,729 | A | | 9/1994 | Saunders | 72/349 |
| 5,347,839 | A | | 9/1994 | Saunders | 72/347 |
| 5,409,130 | A | | 4/1995 | Saunders | 220/458 |
| 5,522,248 | A | | 6/1996 | Diekhoff et al. | 72/348 |
| 5,626,046 | A | | 5/1997 | Main | 72/273 |
| 5,647,242 | A | | 7/1997 | Saunders | 72/349 |
| 5,689,992 | A | | 11/1997 | Saunders et al. | 72/347 |
| 5,732,850 | A | | 3/1998 | Saunders et al. | 220/604 |

* cited by examiner

*Primary Examiner*—Lowell A. Larson
(74) *Attorney, Agent, or Firm*—Woodcock Washburn LLP

(57) ABSTRACT

A bottom forming station for forming a metal can having a sidewall and base portion is provided. The bottom forming station comprises a punch sleeve. The punch sleeve comprises a body having a sidewall that defines a bore for securely receiving a punch nose. The punch sleeve sidewall has a first section that corresponds to the shape of at least a portion of a beverage can base. The punch sleeve sidewall has a second section that corresponds to at least a portion of a beverage can sidewall profile. The second surface is integrally coupled with the first surface. The punch sleeve sidewall has a third section that is adapted to communicate with a punch nose and form a slip line that has a junction area in a non-active area. The third section is integrally coupled with the first and second sections.

A bottom forming station also comprises a punch nose. The punch nose includes a body having a sidewall. The sidewall has a first section that corresponds to the shape of at least a portion of a beverage can base. The punch nose sidewall has a second section that is integrally coupled with the first section. The punch nose is mechanically coupled within the bore of the punch sleeve with the second surface of the punch nose in communication with the third section of the punch sleeve sidewall such that a slip line is formed with a junction area in a non-active area.

8 Claims, 8 Drawing Sheets

PUNCH ASSEMBLY FOR FORMING A BASE IN A METAL BEVERAGE CAN

FIELD OF THE INVENTION

The present invention is related to light-weighted metal beverage cans and more particularly to an apparatus forming the base of such cans.

BACKGROUND OF THE INVENTION

Light-weighted metal beverage cans and apparatus employed in forming the same are well known in the art. Typically, it is desirable to manufacture metal cans with as little material as possible to reduce the weight of the finished can, while maintaining the structural integrity of the same.

In typical can forming processes, metal stock is manipulated through various stages of a forming apparatus to form the shape and size of the finished can. One of the first steps taken in a can forming process is the placement of the metal stock into a cupping press wherein the metal stock is deformed into the shape of a cup. Next, the cup is conveyed to a wall ironing machine and the deformed metal stock is redrawn to start forming the general shape of the sidewall and base of the finished can. After the metal stock is redrawn, the metal stock is passed through one or more ironing stations wherein the metal stock is more finely and accurately manipulated into the final shape of the finished can. In one of the last forming steps, the metal stock is passed into a bottom forming station wherein the base of the metal can is formed into its final shape.

FIG. 1 shows a metal beverage can 10. The can sidewall and base have been formed in accordance with the method described above. The shape of the beverage can 10 is well known to those skilled in the art. Generally, the beverage can 10 has a circumferential sidewall 12 having an upper portion 14 and a lower portion 16. The upper portion 14 of the sidewall 12 is mechanically coupled with a tab end 18. The lower portion 16 of the sidewall is connected to the base 20.

FIGS. 2 and 3 show the base 20 in more detail. The base 20 includes a nose portion 22 upon which the beverage can rests when set upright. The nose portion 22 is connected with a relatively concave dome portion 24 by a gradually smooth transition. The nose portion 22 is also connected to the outer profile 26 by a gradually smooth transition. The outer profile 26 is connected to the lower portion 16 of the metal can sidewall 12 by a gradually smooth transition.

FIG. 4 shows a conventional bottom forming station 28 that may be employed to form the base 20 of the metal beverage can 10. The bottom forming station 28 comprises a ram 30 that is adapted to slide along a relatively horizontal plane from a first position (not shown) to a second position (as shown in FIG. 4). A punch sleeve 32 and a punch nose 34 are mechanically coupled with the ram 30.

The punch sleeve 32 and punch nose 34 are adapted to receive a partially formed metal stock 36. When the ram 30 is at the second position, the punch nose 34 forces the metal stock 36 into engagement with the bottom forming die 38 and ceramic insert 40 under a relatively high impact force, thereby, forming the final shape of the base of the metal can.

The punch sleeve 32 has an outer surface 42 that includes a relatively smooth upper portion 44 that conforms to the shape of the upper portion 14 of the circumferential sidewall 12 of the finished can 10. The outer surface 42 of the punch sleeve 32 also has a generally curved front portion 46 that conforms to the lower portion 16 of the circumferential sidewall 12 of the finished metal can 10. The outer surface 42 includes a lower portion 48 that defines a bore 49 and that is adapted to receive and abut with a portion of the punch nose 34, as described below. The punch sleeve may be made of a steel material, or a carbide material.

The punch nose 34 has an outer surface 52 that includes a protruding portion 54 that conforms to the nose portion 22 of the finished can 10. A relatively upwardly angled front portion 56 is connected to the protruding portion 54 by a gradually smooth transition and conforms to the outer profile 26 of the finished can 10. A downwardly angled back portion 58 is connected to the upwardly angled portion 56 at an apex 60 and is adapted to abut with the lower portion 48 of the punch sleeve 32. The remaining sections of the outer surface 52 of the punch nose 34 are adapted to be slip fit between the punch sleeve 32 and a retaining bolt 62 to maintain the punch nose 34 in an operating position.

The punch nose 34 may be made of a steel material, such as hardened tool steel-M2, or a ceramic material. Punch noses that are made of a steel material are typically coated with a chemical material, such as titanium nitride, for various reasons. One reason is that the chemical material provides a "mobile" surface that enables the metal stock to be drawn to form the base of the metal beverage can with a reduced metal thickness as the punch nose impacts the bottom forming die 38 and ceramic insert of the extractor 40.

In the operating position, the punch nose 34 is placed within the punch sleeve bore 49 such that the punch nose and punch sleeve are securely positioned adjacent one another with a relatively small diametrical clearance —.001 inches. Between punch nose 34 and punch sleeve 32 there is a gap at a location called a split line 64. This gap may measure about .001 inches. The split line 64 has a junction area 66, which is the entrance into the split line 64, proximate the apex 60 of the punch nose 34 and the end of the punch sleeve. In this arrangement, the outer surfaces of the punch sleeve 44 and 46, and punch nose 54 and 56 form the profile of the can body and base.

It is noted that the sections on the punch sleeve and punch nose that the metal stock is in actual contact with as the base is being formed are called "active locations." Those sections on the punch sleeve and punch nose that are not in contact with the metal stock as the base is being formed are called "non-active locations." As shown in FIG. 4, the junction area 66 is located along an active location.

Over time, the punch sleeve 32 and punch nose 34 may become misaligned along the junction area 66. As the metal stock is drawn over a misaligned junction area 66, stress lines may be formed in the base of the finished metal can. The area around a stress line is likely to corrode and then crack after the beverage can is filled with a liquid. It would, therefore, be desirable to provide an apparatus that reduces the likelihood of stress lines being formed in he base of a finished metal can.

Conventional methods of maintaining the punch nose 34 and punch sleeve 32 in a proper alignment require corresponding punch noses and punch sleeves to be manufactured within substantially tight tolerances. The manufacturing of punch noses and punch sleeves within these tight tolerances is relatively difficult and costly to obtain. It would, therefore, be desirable to provide a base forming apparatus that is relatively more efficient to manufacture.

The chemical coating that is applied over the outer surface of a steel punch nose is likely to crack and dislodge from the punch nose during the base forming operation. The dislodged chemical flakes are likely to accumulate along the junction area 66 and contact the metal stock 36 as the metal stock is drawn. Unfortunately, these chemical flakes scratch the metal stock as the base of the finished metal can is being formed. The area around these scratches is likely to corrode and then crack after the beverage can is filled with a liquid. It would, therefore, be desirable to provide an apparatus that reduces the likelihood of scratches being formed on the base of a metal beverage can.

SUMMARY OF THE INVENTION

A punch sleeve in a bottom forming station for forming a metal beverage can having a sidewall and base portion is provided. The punch sleeve comprises a body having a sidewall that defines a bore for securely receiving a punch nose. The sidewall has a first section that corresponds to the shape of at least a portion of a beverage can base. The sidewall has a second section that corresponds to at least a portion of a can sidewall. The second section is integrally coupled with the first section. The sidewall also has a third section that is adapted to communicate with a punch nose and form a slip line that has a junction area in a non-active area. The third section is integrally coupled with the first and second sections.

In another embodiment, a punch sleeve as described above, having a body made of carbide material, is provided.

A punch nose for a bottom forming station for forming a metal beverage can having a sidewall and a base portion is provided. The punch nose comprises a body having a sidewall which has a first section that corresponds to the shape of at least a portion of a beverage can base. The punch nose sidewall has a second section that is integrally coupled with the first section. The second section is adapted to communicate with a punch sleeve and form a slip line that has a junction area in a non-active area. The slip line has a close slip fit wherein there is no perceptible play radially between the punch nose and punch sleeve.

A punch nose as described above having a body made of a ceramic material, a carbide material, or a steel material with a coating is provided.

Yet another embodiment of a punch sleeve for a bottom forming station for forming a base of a metal beverage can that has a sidewall and base is provided. This punch sleeve comprises a body having a first open end and a second open end. The body has an outer surface, which is adapted to receive metal stock that is to be drawn into the finished metal beverage can. The outer surface has a first section that extends from the first open end of the body to a location proximate the second open end of the body. The first portion corresponds to a can sidewall profile. A second section is integrally coupled with the first section. The second section corresponds to the profile of the base portion of a metal can. An inner surface extends from the first opened end of the body to the second open end of the body. The inner surface is integrally coupled with the second section and defines a bore that extends from the first open end of the body towards the second open end of the body. The bore is adapted to mechanically couple with a ram and a punch nose for forming the base of a finished metal beverage can. The inner surface further has a relatively angled potion proximate the second open end. The angled surface is formed at an angle that is between 170 degrees and about 180 degrees relative to the outer portion such that a slip line is formed with a junction area at a non-active location when the ram and punch nose are mechanically coupled within the recess.

A punch sleeve as described above, wherein the second section further includes a curved potion that corresponds to the outer profile of a metal can base for a metal beverage can is provided.

Yet another embodiment of a punch nose for a bottom forming station for forming the base of a metal beverage can is provided. This punch nose comprises a body portion having a sidewall that is adapted to be mechanically coupled with a punch sleeve by a retaining member. The sidewall has a support portion that is adapted to communicate with a retaining member to support the punch nose in an operating position. The base portion has a first and second end. A protruding portion that conforms to the nose portion of the base of a finished metal can is integrally connected to the support position. An upper surface is integrally connected to the protruding portion. The upper surface is adapted to communicate with a punch sleeve and form a slip line having a junction area in a non-active area.

A punch sleeve as described above, wherein the upper surface extends at a relative angle of about 30 to 45 degrees and is adapted to communicate with a punch nose to form a slip line with a junction area in a non-active area, is provided.

A bottom forming station for forming a metal can having a sidewall and a base portion is provided. The bottom forming station comprises a punch sleeve having a body. The body has a sidewall that defines a bore for securely receiving punch nose. The sidewall has a first section that corresponds to the shape of at least a portion of a beverage can base. The sidewall also has a second section that corresponds to at least a portion of a can sidewall. The second section is integrally coupled with the first section. The sidewall also has a third section that is adapted to communicate with a punch nose and form a slip line that has junction area in a non-active area. The third section is integrally coupled with the first and second sections.

The bottom forming station further comprises a punch nose. The punch nose comprises a body having a sidewall. The sidewall has a first section that corresponds to the shape of at least a portion of a beverage can base. The sidewall also has a second section integrally coupled with the first section, said punch nose adapted to be mechanically coupled within the bore of the punch sleeve with the second section of the punch nose in communication with the third section of the punch sleeve sidewall such that a slip line is formed with a junction area in a non-active area.

A bottom forming station as described just above, wherein the third section of the punch sleeve and the sidewall of the punch nose are at a relative angle of between about 170 degrees and about 180 degrees from horizontal, such that when in contact with one another a substantially horizontal slip line is formed with a junction area at a non-active location, is provided.

DETAILED DESCRIPTION OF THE PREFERRED EMBODIMENTS

Figure 1:
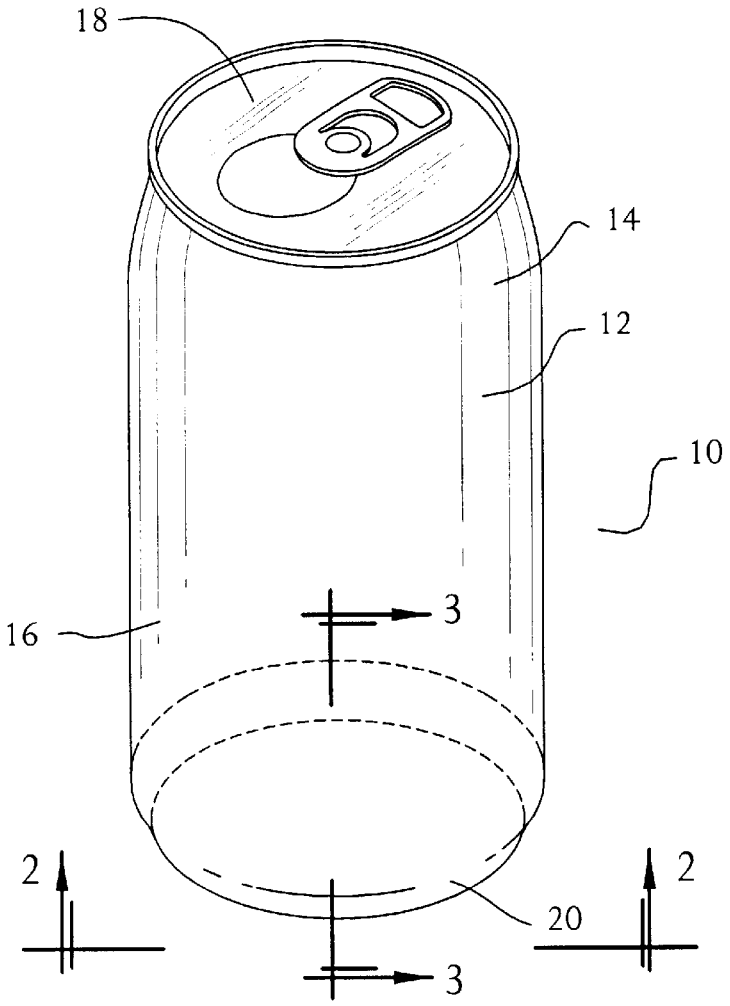
FIG. 1 is a perspective view of a metal beverage can that can be made in accordance with the present invention.
Figure 2:
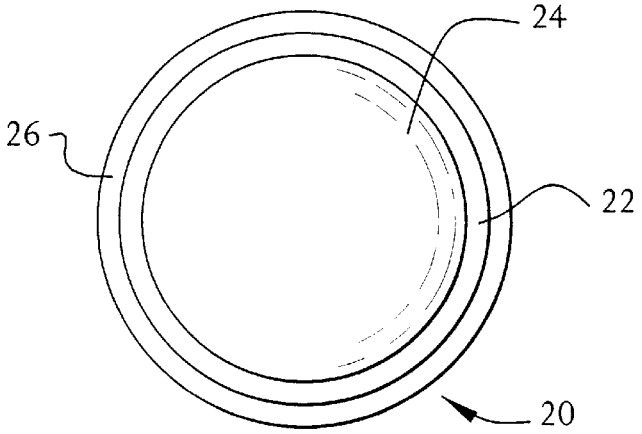
FIG. 2 is a bottom view of the base of the metal can taken along line 2—2 shown in FIG. 1.
Figure 3:
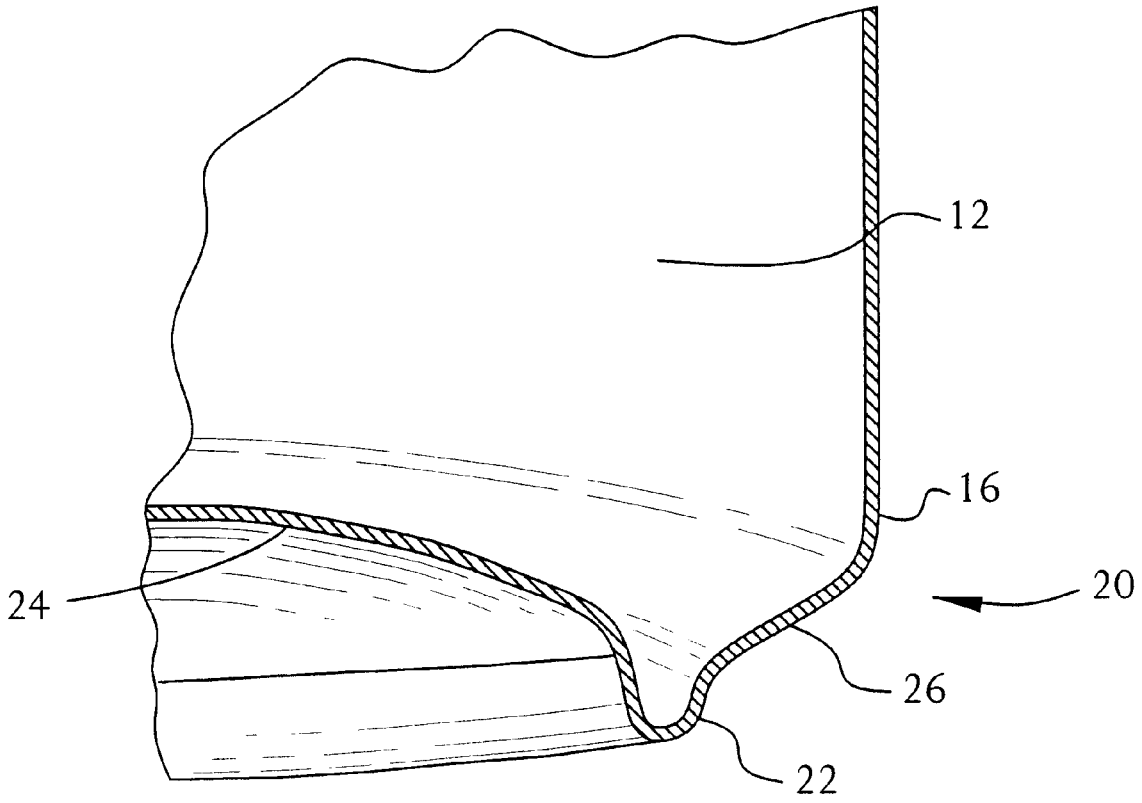
FIG. 3 is a partial sectional view of the base taken along line 3—3 in FIG. 1.
Figure 4:
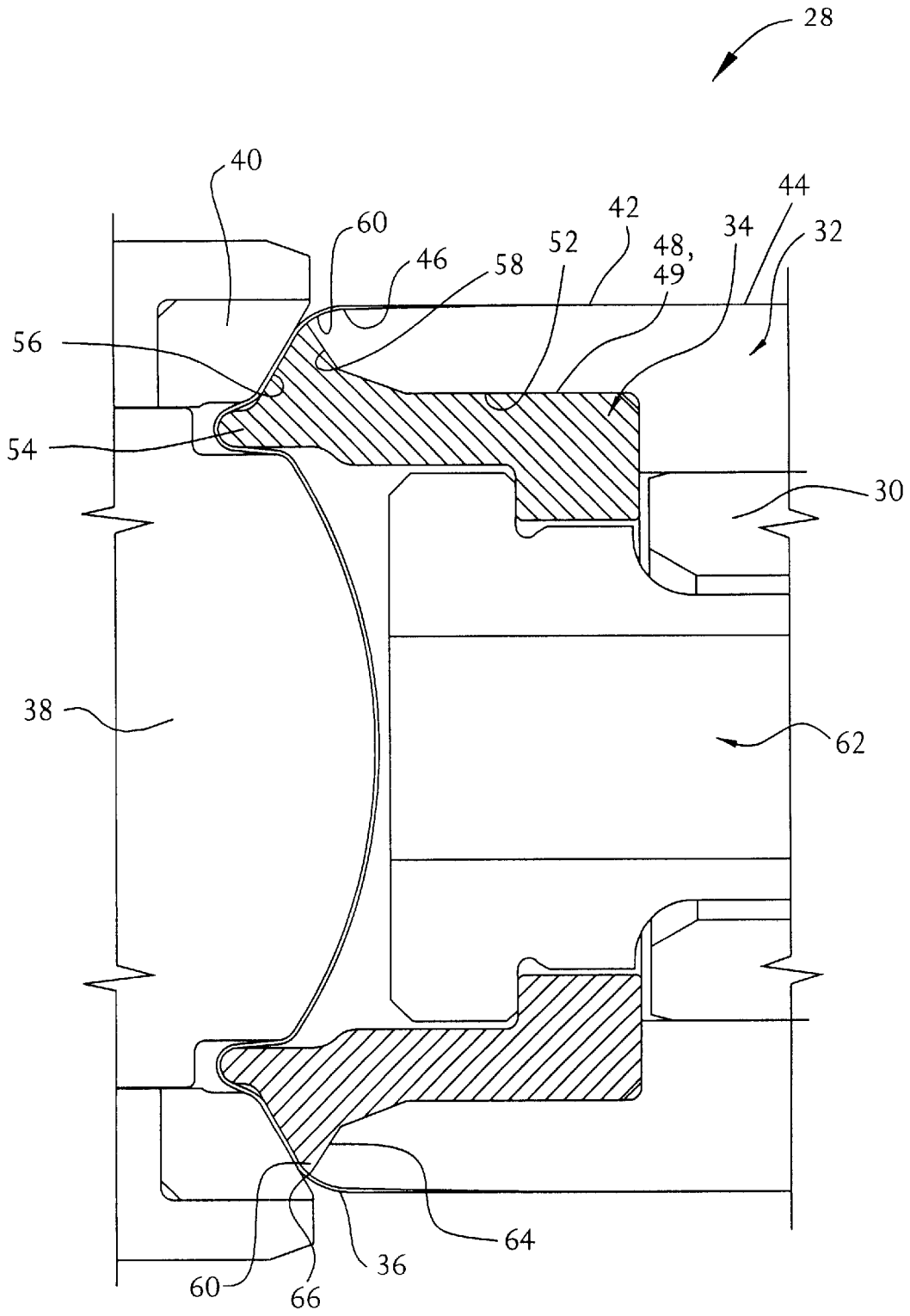
FIG. 4 is sectional view of a conventional bottom forming station.
Figure 5:
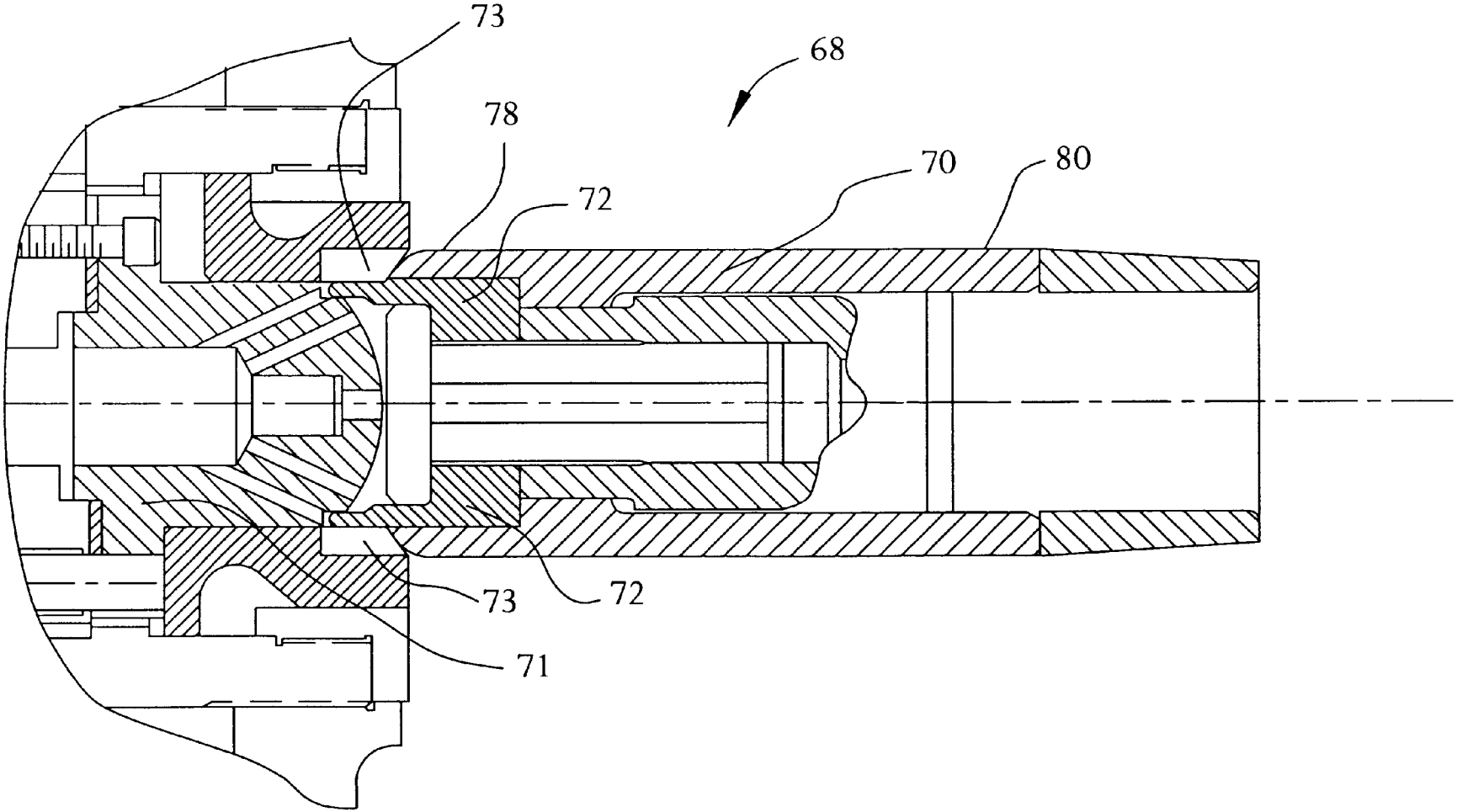
FIG. 5 is sectional view of a bottom forming station in accordance with the present invention.

FIG. 5 illustrates a bottom forming station 68 that may be employed to form light-weighted metal beverage cans in accordance with the present invention. The bottom forming station 68 comprises a punch sleeve 70, which has a first end 78 and second end 80, that is adapted to support a punch nose 72. A bottom forming die 71 and ceramic inserts 73 are adapted to engage the punch sleeve 70 and punch nose 72 to form the base 20 of the metal can 10. The bottom forming station 68 is employed to manufacture metal beverage cans that can hold various capacities of a carbonated beverage (preferably twelve ounces).

Figure 6:
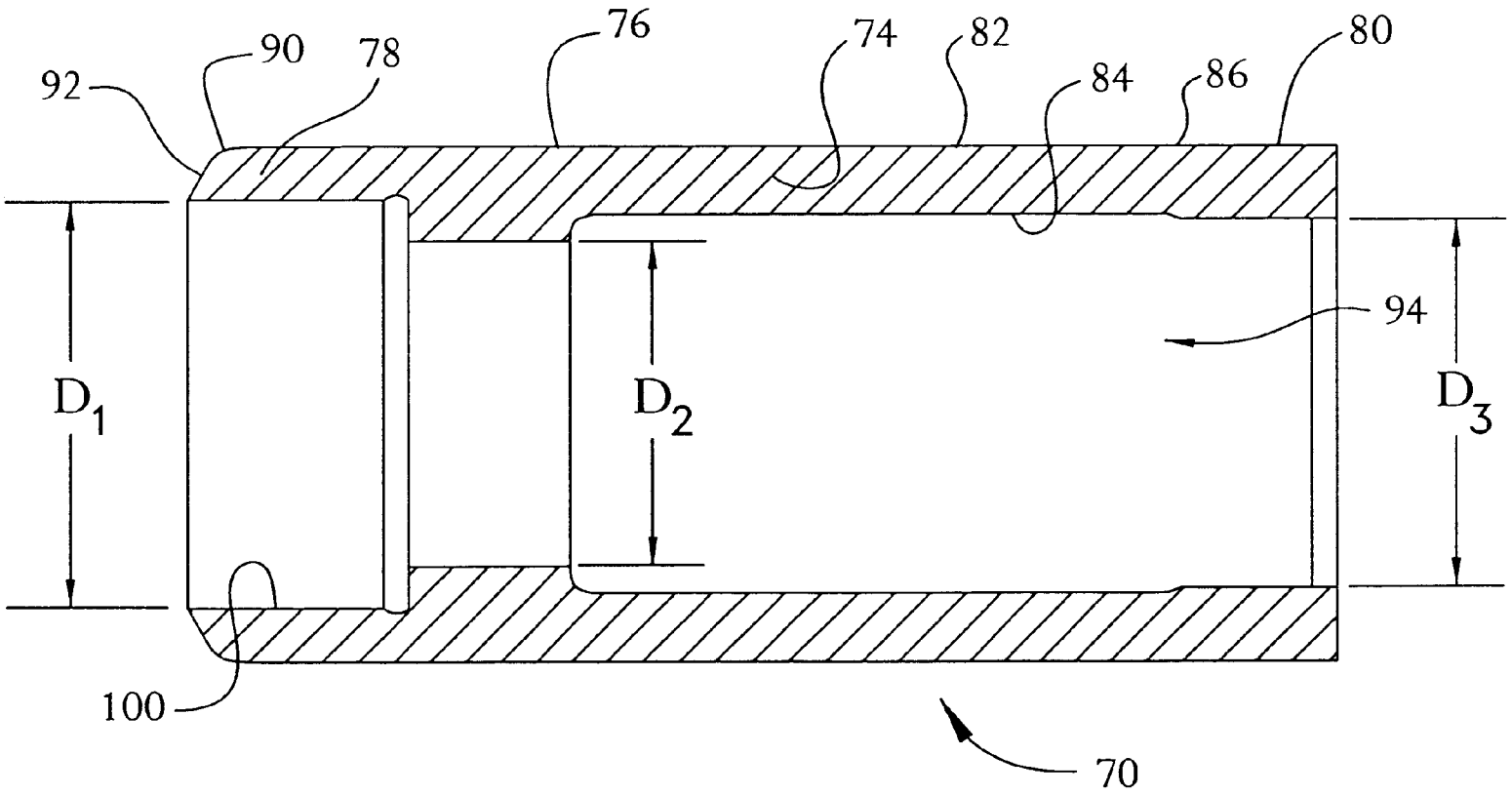
FIG. 6 is a sectional view of a punch sleeve in accordance with one aspect of the present invention that is employed in the bottom forming station shown in FIG. 5.
Figure 8:
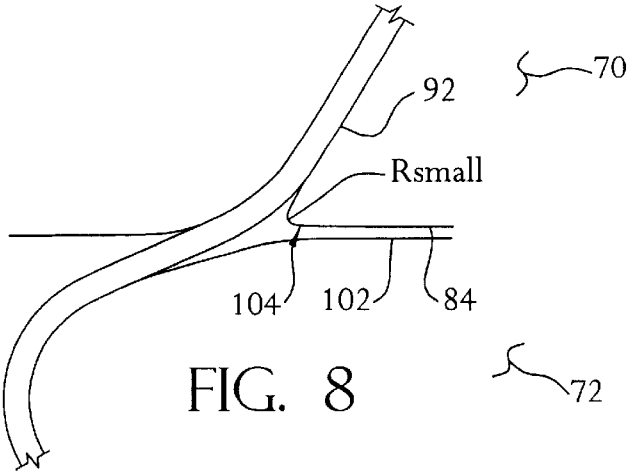
FIG. 8 is an enlarged sectional view of a junction area taken along line 8—8 in FIG. 7.
Figure 7:
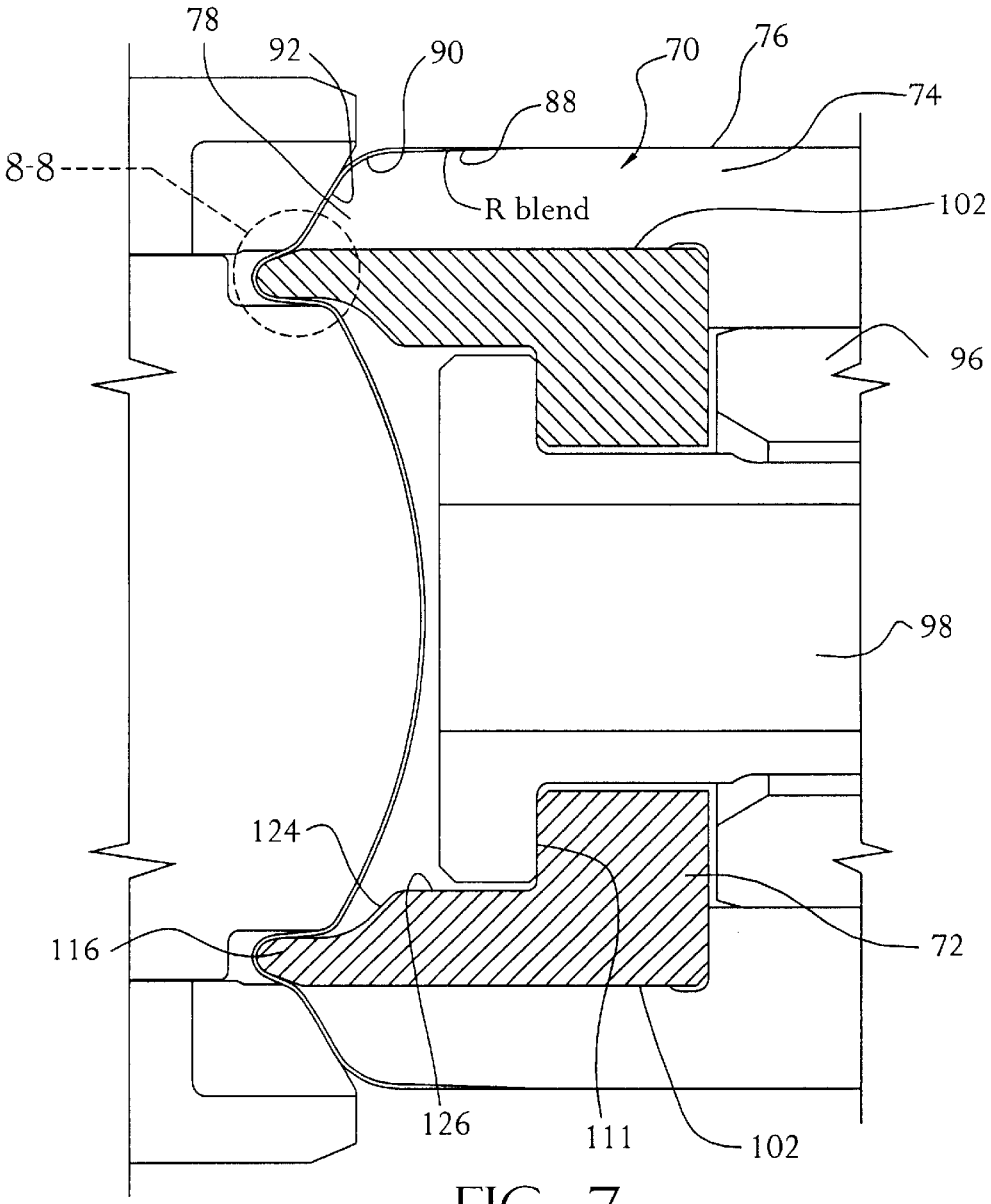
FIG. 7 is an enlarged partial sectional view of a portion of the bottom forming station shown in FIG. 5.

FIGS. 6 through 8 illustrate the punch sleeve 70 in more detail. The punch sleeve 70 comprises a body portion 74 having a sidewall 76 that extends between the first end 78 and second end 80. The sidewall 76 includes an outer surface 82 that is adapted to receive metal stock and aid in the formation of the finished metal can. Additionally, the sidewall 76 has an inner surface 84 which is discussed in more detail below.

Preferably, the punch sleeve 70 is made of a carbide material. Preferably, the outer surface 82 is a generally circumferential, smooth surface. Preferably, the outer surface 82 has a diameter of about 2.60 inches. Additionally, the sidewall is approximately 5.58 inches long.

Preferably, the outer surface 82 has a relatively elongated portion 86 that extends from the second end 80 to a location proximate the first end 78. The elongated portion 86 conforms to the final shape of the upper portion 14 and to the lower portion 16 of the circumferential sidewall 12 of the beverage can 10.

Preferably, the outer surface 82 of the punch sleeve 70 has an angled section 88 (shown best in FIG. 7) that is connected to the sidewall 76 by a blend radius $R_{blend}$ of about 4.00 inches. The angled section 88 corresponds to the lower portion 16 of the circumferential sidewall of the finished beverage can 10. Preferably, the angled section 88 forms a relative angle with elongated portion 86 that varies from 1° to 1°–30'.

Additionally, the outer surface 82 of the punch sleeve has a curved portion 90 proximate the first open end 78 that conforms to the shape of a section of the lower portion 16 of the circumferential sidewall of the finished can 10. The curved portion 90 is connected to the angled portion 88 by a gradually smooth transition. Preferably, the curved portion 90 has a radius varying from 0.17 to 0.20 inches.

The outer surface 82 also has a relatively truncated portion 92 that is connected to the curved portion 90 by a gradually smooth transition. The truncated portion 92 corresponds to the outer profile 26 of the metal can 10. Preferably, the truncated portion 92 extends at a relatively downwardly extending angle of about 30° away from the curved portion 90.

Proximate the end of first end 78, a relatively small radius $R_{small}$, preferably about 0.005 inches, is connected at one end to the truncated portion 92 by a gradually smooth transition. The small radius portion $R_{small}$ is connected at another end to the inner surface 84 of the sleeve 70 by a gradually smooth transition.

The inner surface 84 of the punch sleeve defines a bore 94 that extends from the first end 78 to the second end 80 of the body 74. The bore 94 is adapted to securely couple with a ram 96 proximate the second end 80. In addition, the bore 94 is adapted to receive a retaining member, preferably retaining bolt 98, and the punch nose 72 proximate the first end 78.

Preferably, the bore 94 has three concentric diameters. The first diameter $D_1$ is approximately 2.06 inches and extends from the first end 78 of the body 74 towards the second diameter $D_2$. The first diameter $D_1$ is adapted to enable the punch nose 72 to be securely mounted therein. The second diameter $D_2$ is approximately 1.65 inches and extends towards the third diameter $D_3$. The second diameter $D_2$ is adapted to securely receive the ram 96 and retaining bolt 98 therein. The third diameter $D_3$ is approximately 1.86 inches and extends proximate the second end 80 of the body 74 and is adapted to be securely positioned over the ram 96.

In accordance with one aspect of the present invention, the section 100 of the inner surface 84 that defines the first diameter $D_1$ is formed such that when the punch nose is securely coupled within the first diameter $D_1$ of the bore 94, a slip line 102 is formed having a junction area 104 located at a non-active location 104. Preferably, the slip line 102 has a diametrical clearance gap of about 0.001 inches. Preferably, the section 100 is formed such when a sectional view is taken of the punch sleeve and punch nose as shown in the figures, a relatively substantially horizontal slip line 102 is formed. More preferably, the section 100 is formed at a relative angle between about 170 degrees and about 180 degrees. Even more preferably, the junction area 104 is located proximate to that area which corresponds to that area proximate the outer profile 26 and nose portion 22 of the finished can 10.

Figure 9:
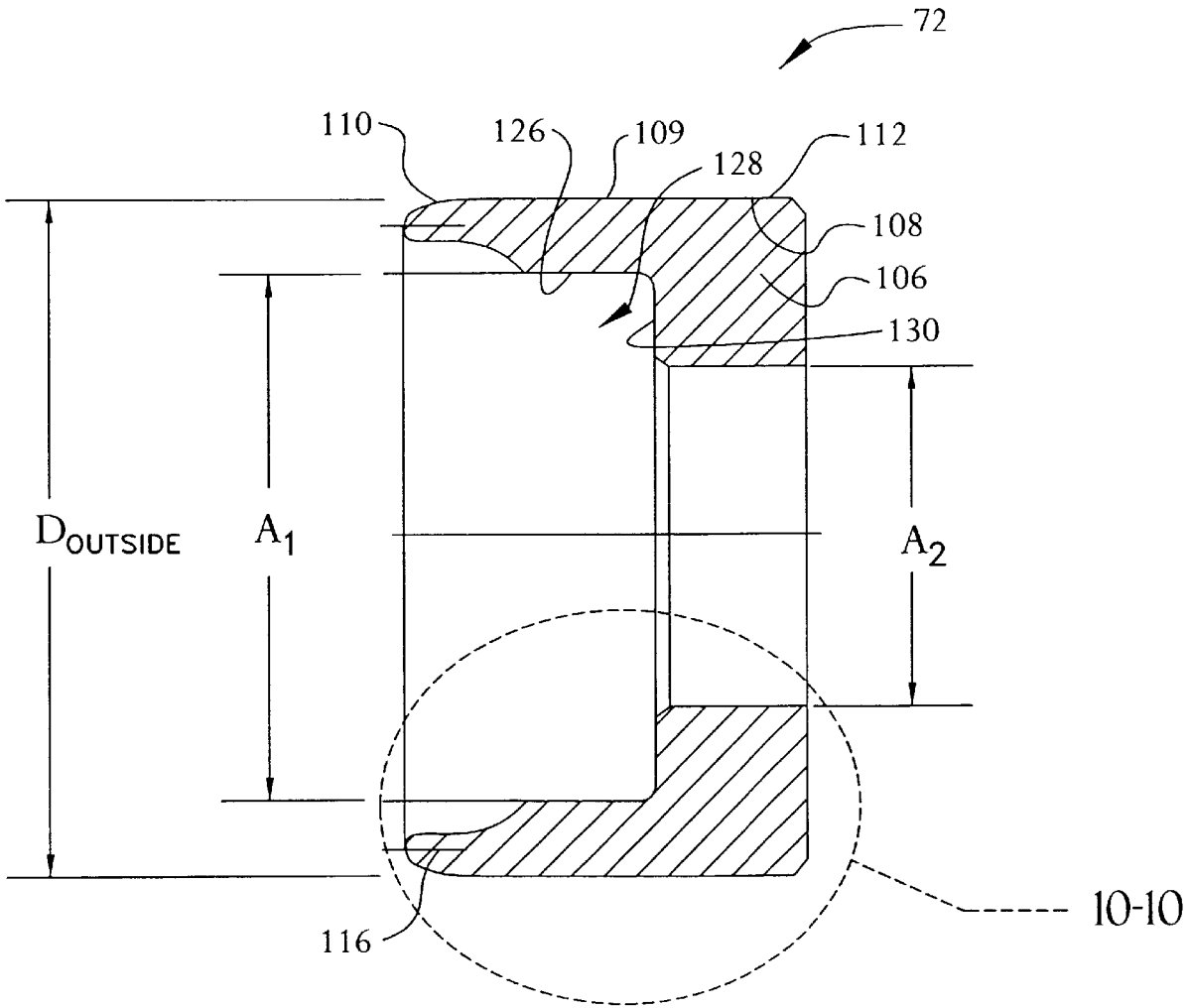
FIG. 9 is a sectional view of a punch nose in accordance with another aspect of the present invention that is employed in the bottom forming station shown in FIG. 5.
Figure 10:
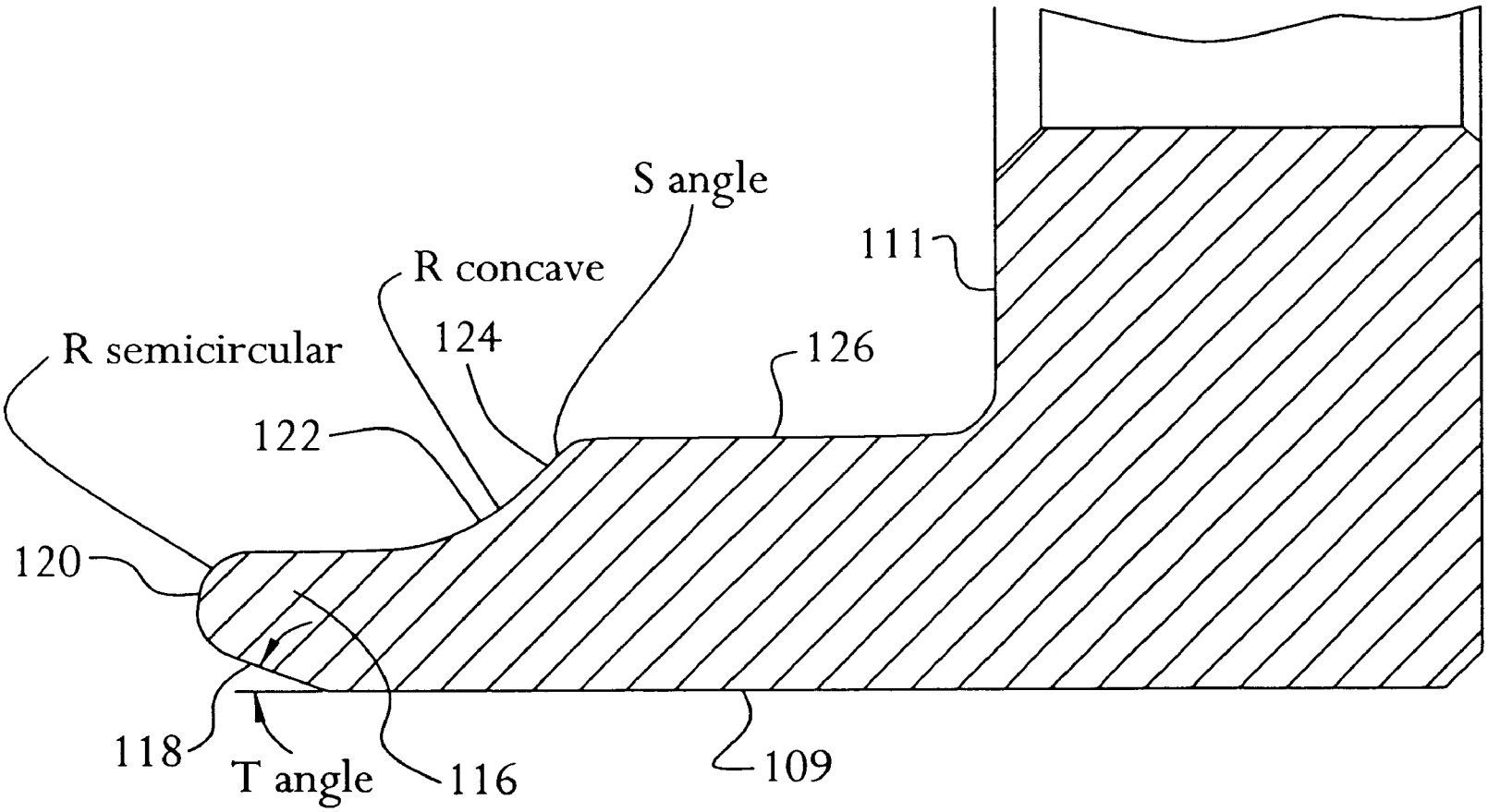
FIG. 10 is an enlarged partial sectional view of the punch nose taken along line 10—10 shown in FIG. 9.

Referring to FIGS. 9 and 10, the punch nose 72 is shown in more detail. The punch nose 72 comprises a generally circumferential body portion 106 having sidewall 108 that has a first end 110 and a second end 112. The sidewall 108 has an outer section 109 that is adapted to communicate with the inner surface section 100 of the punch sleeve 70. Preferably, the outer section 109 of the punch nose sidewall 108 is formed such that when a section line is taken of the punch sleeve and punch nose as shown in the figures, the slip line 102 is formed with the junction area 104 in a non-active area.

Additionally, the punch nose sidewall 108 has a section 111 that is adapted to communicate with the retaining bolt 98 and maintain the punch nose 72 in an operating position within the bore 94 of the punch sleeve.

Preferably, the circumferential body portion 106 of the punch nose has an outside diameter $D_{outside}$ of about 2.06 inches. The length of the punch nose 72 is approximately 1.17 inches.

The outer surface 109 of the punch nose 72 has a protruding portion 116 that conforms to the shape of the nose portion 22 of the beverage can 10. The protruding portion 116 is connected proximate the first end 110 of the sidewall 108 by a gradually smooth transition.

Preferably, the protruding portion 116 includes a tapered surface 118 that is formed at a relative angle $T_{angle}$ of about 15° to 25° relative to the outer surface 109 as shown in the figures. The protruding portion 116 also includes a relatively semi-circular portion 120 that is connected to the tapered surface 118 by a gradually smooth transition. The semicircular portion 120 has a radius $R_{semicircular}$ of about 0.045 to 0.060 inches. The protruding portion 116 also includes a concave portion 122 that is connected to the semi-circular portion 120 by a gradually smooth transition. The concave portion 122 has a radius $R_{concave}$ of about 0.20 inches. The concave portion 122 gradually merges with a generally smooth angled surface $S_{angle}$ 124 that is at an angle of about 45°. The angled surface 124 gradually merges into an inner surface 126 of the punch nose 72.

The inner surface 126 of the punch nose 72 defines a through hole 128 that extends between the first end 110 and second end 112 of the punch nose 72. The through hole 128 is adapted to receive the retaining bolt 98 to secure the punch nose 72 within the punch sleeve bore 94.

Preferably, the through hole 128 has two concentric diameters, $A_1$ and $A_2$ that are adapted to receive a retaining bolt 98 having a corresponding profile. The first diameter $A_1$ is approximately 1.60 inches, and the second diameter $A_2$ is approximately 1.07 inches. Preferably, the inner surface 130 between the first diameter $A_1$ and second diameter $A_2$ defines a boss that is adapted to maintain the retaining bolt 98 therein.

Preferably the punch nose is made of a ceramic material. The use of a ceramic material will increase the mobility of the metal stock around the protruding portion 116 as the punch sleeve contacts the extractor and the metal stock forms the base over the bottom forming die. It is noted that the punch nose can be made of a steel material, such as harden tool steel-M2. For steel punch noses, a chemical coating, such as titanium nitride is applied to the steel for mobility purposes. The punch nose can be made also of a carbide material.

In operation, the punch sleeve 70 is mechanically coupled to the ram 96. The punch nose 72 is secured within the punch sleeve bore 94. Metal stock is positioned over the sleeve and punch nose. The ram moves along a relatively horizontal plane from a first resting position to a second position wherein the metal stock engages the bottom forming die under relatively high pressure. Under this pressure, the metal stock is drawn over the outer surface of the punch sleeve and protruding portion 116 of the punch nose 72 to form the base of the metal can. The metal stock, however, is not in contact with either the punch sleeve or punch nose at a non-active area proximate the junction area 104 of the slip line 102.

The bottom forming station in accordance with the present invention provides several advantages over the prior art. One advantage is that the punch sleeve and punch nose can be manufactured more easily than conventional punch noses and punch sleeves. The outer surfaces of each component that contact each other to form the slip line can be manufactured within less restrictive tolerances such that the junction area is located at a non-active location.

With the junction area in a non-active location, other operating advantages are presented. For example, when a chemical coating is present on the punch sleeves or punch nose structure, any chemical flakes that are created may accumulate at the junction area, thereby, reducing the potential of any flakes of scratching the metal stock.

Yet another advantage of providing the junction area in a non-active location is that when the punch sleeve and punch nose are misaligned, thereby, misaligning the junction area, the misaligned junction area will not be included in the forming profiles of the punch sleeve and punch nose. Thus, reducing the risk of stress lines forming in the metal stock as the metal stock is drawn into the base of the metal can.

Further, moving the split line from an active to a non-active location in the forming of the bottom profile of the can provides the advantage that there is no interruption in the active profile of parts that form the outer bottom profile. Eliminating the interruption provides smoother metal flow over the forming profile. The thinner the metal that is used in can making, the more important it is to obtain smooth metal flow over forming surfaces without introducing distortion that could lead to metal fractures.

Eliminating interruption in the forming profile illuminates an area where fine aluminum particles can build up and cause internal scratching of the can body. Consequences of scratching are (1) bottom dome fractures from metal stretching--build ups which can cause friction areas but whereby metal will stretch excessively during bottom forming (the stretch areas are weak spots susceptible to failure); and (2) scratched areas can be difficult to apply the protective spray coating after body forming. The scratch areas could lead to metal exposure resulting in product contamination. The sharp peaks of scratches offer poor adherence of the spray coat hence metal exposure.

Yet another advantage of moving the split line to (a non-active location is that the punch sleeve absorbs a vast majority of the heavy impact loading against the extractor at the beginning of bottom forming. The punch sleeve, because of its larger size compared to the punch nose, is a more durable part for accepting loading. This advantage is especially important because typical designs require the punch nose to absorb most of the loading.

Another advantage is that manufacturing costs of punch parts are reduced because of not having to have precisely matched profiles where the punch nose profile interfaces with the punch sleeve profile.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A bottom forming station assembly for forming a metal can bottom having a sidewall and a base portion, said bottom being formed in a single-stage process after drawing and ironing, said station assembly comprising:

a punch sleeve comprising a body having:

an inner sidewall that defines a bore for securely receiving a punch nose;

an outer sidewall that corresponds to a shape of at least a portion of a beverage can base, the outer sidewall including a first portion and a second portion, the second portion corresponding to at least a portion of a can sidewall, the first portion being oblique to the second portion and extending radially inwardly therefrom such that an end of the first portion is coupled to the inner sidewall; and the punch nose comprising a body having:

a first sidewall that corresponds to the shape of at least a portion of a beverage can base; and a a second sidewall integrally coupled with the first sidewall and extending rearwardly therefrom, said punch nose adapted to be mechanically coupled within the bore of the punch sleeve with the second sidewall of the punch nose proximate to the first portion of the outer sidewall of the punch sleeve sidewall; and a die assembly, disposed opposite the punch assembly, comprising a domed portion and an annular insert disposed around the domed portion, the insert being immoveable relative to the domed portion and sized to removably receive a portion of the punch nose therein;

such that a slip line is formed at a forward-most junction between the punch sleeve and the punch nose in a non-active area, whereby said non-active area is not in contact with the can base metal stock during forming thereof, whereby said bottom forming station assembly is suitable for forming a metal can bottom dome in a one-stage process and whereby the die insert forms a portion of the can bottom by urging the can bottom portion against the punch outer sidewall first portion.

2. The bottom forming station assembly of claim 1 wherein the inner wall of the punch sleeve and the sidewall of the punch nose are substantially parallel such that when in contact with one another the slip line is substantially horizontal.

3. The bottom forming station assembly of claim 1 wherein said punch sleeve is formed of a carbide material.

4. The bottom forming station assembly of claim 1 wherein the punch nose is formed of a material comprising a ceramic material.

5. The bottom forming station assembly of claim 1 wherein the punch nose is formed of a material comprising a carbide material.

6. The bottom forming station assembly of claim 1 wherein a portion of the outer wall second portion is tapered.

7. The bottom forming station assembly of claim 1 wherein the die assembly and the punch sleeve are capable of forming the can bottom in one-step by relative urging therebetween.

8. The bottom forming station assembly of claim 7 wherein the die assembly consists essentially only of the domed portion and the annular insert.

* * * * *